United States Patent [19]

Redlich

[11] 4,415,902

[45] Nov. 15, 1983

[54] ARRAY FOR REDUCING THE NUMBER OF ANTENNA ELEMENTS FOR RADIATING INSTRUMENT LANDING SYSTEM LOCALIZER SIGNALS

[75] Inventor: Robert W. Redlich, Athens, Ohio

[73] Assignee: The Government of the United States, Washington, D.C.

[21] Appl. No.: 258,793

[22] Filed: Apr. 29, 1981

[51] Int. Cl.[3] ..... H01Q 21/06

[52] U.S. Cl. ..... 343/844; 343/413

[58] Field of Search ..... 343/844, 108 R, 853

[56] References Cited

U.S. PATENT DOCUMENTS 4,336,543 6/1982 Ganz et al. ..... 343/844

*Primary Examiner*—Eli. Lieberman

[57] ABSTRACT

In an antenna array for radiating Instrument Landing System localizer signals, a method for reducing the required number of antenna elements by the combination of average element to element spacing exceeding one wavelength and end-fire directive antenna elements which suppress spurious radiation that would otherwise occur.

1 Claim, 4 Drawing Figures

RELATIVE AMPLITUDE
MAIN GUIDANCE BEAM
SPURIOUS BEAM
10°
20°
30°
40°
50°
60°
70°
80°
90°
AZIMUTH ANGLE

RELATIVE AMPLITUDE
ELEMENT RADIATION PATTERN
MAIN GUIDANCE BEAM
10°
20°
30°
40°
50°
60°
70°
80°
90°
AZIMUTH ANGLE
RESIDUAL SPURIOUS BEAM

ARRAY FOR REDUCING THE NUMBER OF ANTENNA ELEMENTS FOR RADIATING INSTRUMENT LANDING SYSTEM LOCALIZER SIGNALS

BACKGROUND OF THE INVENTION

The Instrument Landing System (ILS) localizer provides azimuth guidance to aircraft on final approach to landing, by radiating guidance signals from an antenna array located at the stop end of the runway and disposed perpendicular to the runway. Early localizer arrays used antenna elements that were nearly omnidirectional in a horizontal plane, in order to generate both a front and back course, and to transmit all-around "clearance" (full scale right or left) signals. Courses radiated by early installations were sometimes seriously disturbed by localizer signals reflected from buildings, parked and taxiing aircraft, and aircraft flying over the localizer array. Partly for the purpose of reducing these disturbances, the requirements for a back course and all around clearance were dropped, thus admitting the use of arrays whose radiation patterns were confined to a relatively small angular region on either side of the runway centerline. Reduction in disturbance of the localizer course by aircraft flying over the localizer array was achieved by the use of large corner reflector screens, or with end-fire antenna elements. The latter have come into widespread use in modern localizer antenna arrays. The directivity of the end-fire element, in addition to reducing overflight interference, also practically eliminates the back course, and permits the use of low power solid state transmitters.

Even with relaxed requirements for clearance and back course, and the employment of arrays using end-fire elements, it proved difficult or impossible to meet specifications for localizer course straightness at some sites, because the angular width of the localizer radiation pattern was still not narrow enough to avoid the illumination of reflecting objects by localizer signals which were subsequently reflected into the approach path and produced bends in the localizer course. If the radiation pattern is to be made narrower, antenna theory teaches that the "aperture" (overall length perpendicular to the runway) of the localizer array must be increased. Any increase in aperture must be accompanied by an increase in the number of elements, according to conventional array design procedure, to avoid the appearance of spurious radiation which will occur if the spacing between antenna elements exceeds one wavelength, such spurious radiation being often referred to in the literature on optical or antenna design as a "interferometer lobe" or "grating lobe" . Antenna theory teaches that if main beams of the array are directed toward angles $\pm\theta_o$ from a line perpendicular to the array and if the spacing between antennas is S, then interferometer lobes will appear in the array factor at angles $\pm\psi$ as determined from the equation $\psi=\sin^{-1}(\lambda/S-\sin\theta_o)$, array factor being conventionally defined as the radiation pattern of the array that would exist if all elements of the array radiated isotropically. In an array designed for the narrowest possible radiation pattern consistent with course width requirements, these considerations lead to a design employing a relatively large number of elements, which is undesirable from the standpoints of cost, reliability, and maintenance. It is the object of the present invention to reduce the number of elements required in a wide aperture localizer array, by using to advantage the directivity of end-fire antenna elements that would be employed in any case to minimize overflight interference and reduce required transmitter power.

SUMMARY OF THE INVENTION

The main guidance beam radiated by a localizer array (in ILS terminology, the "course sideband pattern"), must have a null in the direction of runway centerline and be antisymmetric about runway centerline. It will have maxima at angles $\pm\theta_o$ from runway centerline, $\theta_o$ being typically between 3° and 5°, and a second null or deep minimum at an angle that is inversely proportional to the aperture of the array. This angle should be minimized to reduce localizer course disturbances due to reflections, but it cannot be lower than than about 7° without conflicting with course width specifications. An array which radiates an antisymmetric pattern having a null on centerline and a second null (or deep minimum) at 7° from centerline must, from basic antenna theory, have an aperture of about 15 wavelengths (about 135 feet at the localizer band center of 110 mhz.). A conventional design such as has been employed prior to the present invention would require an element-to-element spacing less than 0.89 wavelengths, to avoid the appearance of a grating lobe. Thus, a localizer array designed conventionally for maximum feasible reduction in course disturbances due to reflection will require a minimum of 18 elements. According to the present invention the minimum required number of elements is reduced to 14 by allowing a grating lobe to appear, but attenuating it to a tolerable level by means of the directivity of end-fire antenna elements which would be employed in any case to reduce overflight interference and transmitter power. In the present invention, element-to element spacing is taken as approximately 1.15 wavelengths (vs. 0.89 for conventional design). This causes a grating lobe to appear at about 60° from runway centerline, which is approximately the position of a null in the radiation pattern of the end-fire directive elements used for localizer arrays in the U.S.A. Therefore, the grating lobe is strongly attenuated, typically to a level 25 decibels or more below the peak of the main guidance beam radiation. According to the present invention, it is not necessary for element-to element spacing to be the same throughout the array; it is in fact advantageous to use different spacings for the achievement of precise radiation patterns. Nor is it necessary for a grating lobe to appear precisely at the position of a null in the end-fire element's radiation pattern; it is sufficient that the end-fire element attenuate the grating lobe to a tolerable level. The essential features of the present invention are two; first, an element-to-element spacing exceeding one wavelength on the average, and second, attenuation of the grating lobe resulting from the first feature, by means of the directivity of end-fire antenna elements.

DESCRIPTION OF A TYPICAL EMBODIMENT

Figure 1:
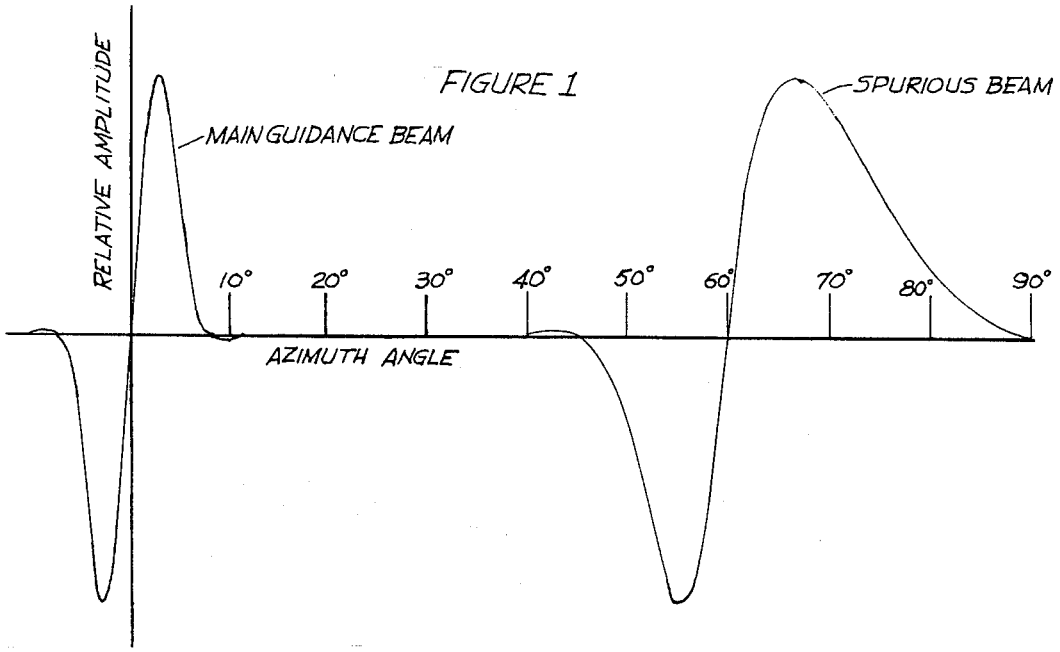
FIG. 1 is a graph of the sideband pattern of a 15 wavelength aperture localizer array employing omnidirectional antenna elements spaced 1.15 wavelengths apart. The Figure illustrates the formation of a spurious beam or grating lobe, which would be inadmissible in practice because of its potential for causing reflection induced course bends.
Figure 2:
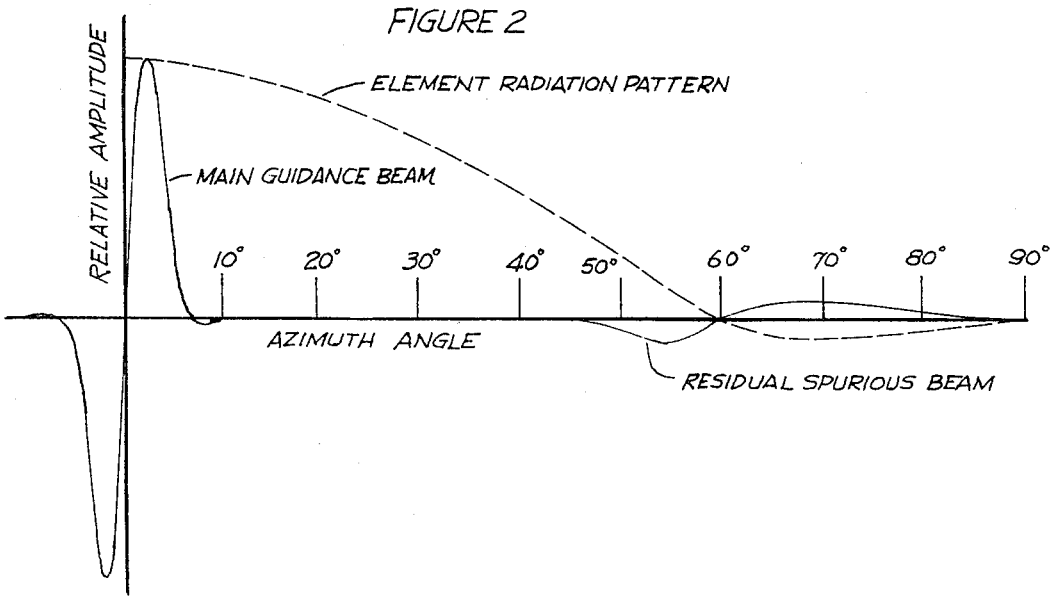
FIG. 2 illustrates how, in accordance with the present invention, the substitution of end-fire directive antenna elements for omnidirectional antenna elements can strongly attenuate the spurious beam shown in FIG. 1, leaving only a residual of tolerable amplitude.
Figure 3:
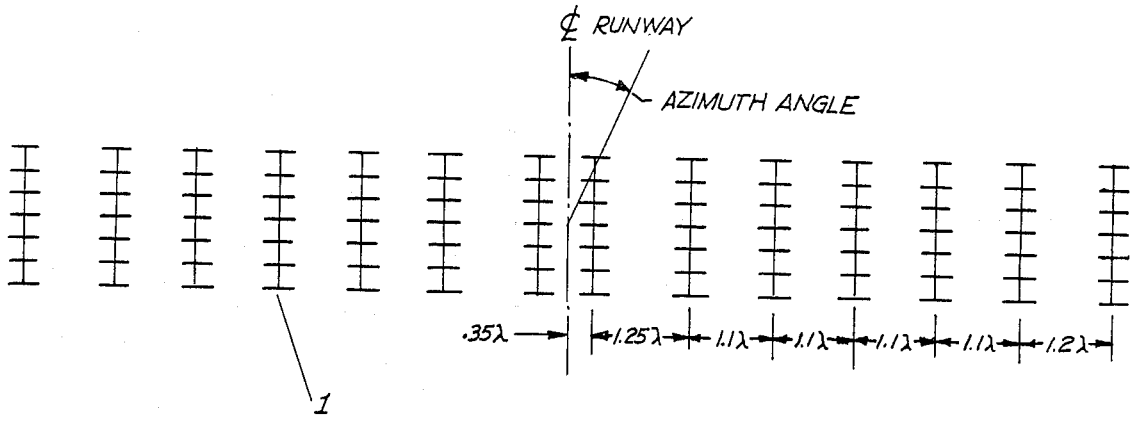
FIG. 3 is a plan view of a localizer array embodying the invention.
Figure 4:
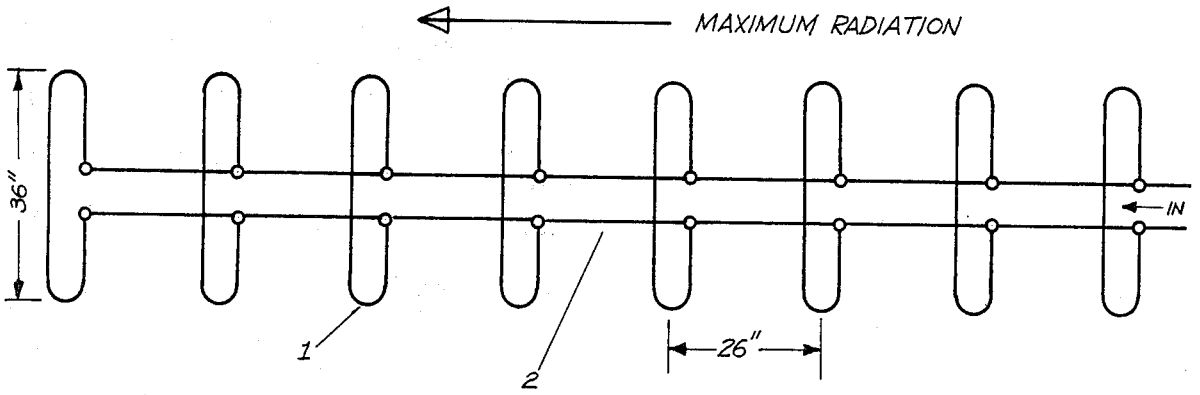
FIG. 4 illustrates one of the several types of end-fire localizer antenna elements presently used in the U.S.A.

With reference to FIG. 3, 1 is one of fourteen end-fire directive antenna elements arrayed perpendicular to runway centerline. Spacings between elements are shown as multiples of wavelength λ. Since the average spacing between elements is 1.10 wavelengths, a grating lobe centered at 65° azimuth appears in this embodiment, but is attenuated by the end-fire element's directivity to a level about 26 decibels below the level that would exist if the array elements were omnidirectional, while the main guidance beam remains practically unchanged. Attenuation of the grating lobe by 26 decibels would be achieved by end-fire elements such as are presently in localizer service in the U.S.A. A measure of the directivity of these elements is the 60° angular separation of the two points on their radiation pattern that are 3 decibels below the central maximum of the radiation pattern, which maximum is aligned on or near runway centerline in localizer service. However, end fire elements with as much as 75° separation between 3 decibel points could still produce acceptable grating lobe attenuation, and end-fire elements with less than 60° separation would be even more effective in attenuating a grating lobe than the presently used elements. Hence, any end-fire element with less than 75° separation between 3 decibel points could be used in a practical embodiment of the invention.

I claim:

1. A linear array of antennas for the purpose of radiating Instrument Landing System Localizer signals at a wavelength λ, said array being characterized by the combination of;

(a) a course sideband radiation pattern having peaks at angles $\pm\theta_o$ from a line perpendicular to the line of said array, $\theta_o$ being typically between three and five degrees, (b) average spacing S between antennas such that S exceeds λ, with the consequence that spurious interferometer lobes appear in the course sideband array factor of said array at angles $\pm\psi$ from a line perpendicular to the line of said array, $\psi$ being determined from the formula $$\psi=\sin^{-1}(\lambda/S-\sin\theta_o),$$

(c) endfire antennas whose radiation pattern in a direction perpendicular to the line of said array is at least 12 decibels higher than the radiation from said antennas in a direction at said angle $\psi$ from a line perpendicular to the line of said array.

* * * * *